US006012654A

United States Patent [19]

Fleissner

[11] Patent Number: 6,012,654

[45] Date of Patent: Jan. 11, 2000

[54] NOZZLE BEAM ON A DEVICE FOR GENERATING LIQUID STREAMS

[75] Inventor: Gerold Fleissner, Zug, Germany

[73] Assignee: Fleissner GmbH & Co., Egelsbach, Germany

[21] Appl. No.: 09/173,540

[22] Filed: Oct. 16, 1998

[30] Foreign Application Priority Data

Oct. 17, 1997 [DE] Germany ..... 197 45 661

[51] Int. Cl.[7] ..... B05B 1/14

[52] U.S. Cl. ..... 239/553.5; 239/600; 28/105

[58] Field of Search ..... 239/553, 553.5, 239/553.3, 590, 590.3, 590.5, 600; 28/104, 105

[56] References Cited

U.S. PATENT DOCUMENTS

| | | | |
|---|---|---|---|
| 3,613,999 | 10/1971 | Bentley et al. | 239/553.3 |
| 4,069,563 | 1/1978 | Contractor et al. | 28/105 |
| 4,880,168 | 11/1989 | Randall, Jr. et al. | 239/553.5 |
| 5,042,722 | 8/1991 | Randall, Jr. | 239/553.5 |
| 5,692,278 | 12/1997 | Fleissner | 239/553.5 X |

*Primary Examiner*—Lesley D. Morris
*Attorney, Agent, or Firm*—Antonelli, Terry, Stout & Kraus, LLP

[57] ABSTRACT

The nozzle beam on a device for producing liquid streams for stream interlacing of fibers, for example of a fiber web guided along the beam, consists of an upper part that extends over the working width of the fiber web and a lower part fastened thereto in a fluid-tight manner. On the nozzle beam, on its lower part, a nozzle sheet is mounted with the holes for the nozzles in a fluid-tight manner by means of a sealing O-ring. This O-ring can be replaced without disassembling the lower part from the upper part. In order for this to be readily possible, in the nozzle beam, over its entire length and width and opposite the bearing groove for the O-ring of the lower part, in the upper part of the nozzle beam, a repair groove is provided which is dimensioned vertically slightly larger than the thickness of the O-ring. By means of the repair groove, an elongate strip on which a replacement O-ring is mounted can easily be inserted. The elongate strip carries the O-ring in a considerably stretched state so that its diameter is reduced. The bearing groove is made open at the ends of the nozzle beam so that the O-ring in the stretched state can be introduced, by means of a positioning strip that is inserted into the repair groove, into the bearing groove that is made swallowtail-shaped. Because of the narrowed outer cross section of the bearing groove, the O-ring which is then relaxed can no longer fall or float out of the bearing groove.

12 Claims, 2 Drawing Sheets

NOZZLE BEAM ON A DEVICE FOR GENERATING LIQUID STREAMS

BACKGROUND OF THE INVENTION

The invention relates to a nozzle beam on a device for generating liquid streams, for example for stream interlacing of the fiber web guided along the beam, a) which consists preferably of an upper part extending over the working width of the web of goods and a lower part fastened thereto in a fluid-tight manner,
   i) with a pressure chamber being located in the upper part over its length, to which the liquid, under pressure, is supplied endwise for example,
   ii) and with a nozzle sheet with the holes for the nozzles being mounted to the lower part in a fluid-tight manner by an O-ring, said ring being held on three sides in a U-shaped bearing groove in the lower part, and b) additionally, in the nozzle beam, over the entire length and width, opposite the bearing groove, in the upper part of the nozzle beam, a repair groove is provided that is endwise of the nozzle beam and is open on at least one side but is closable, said groove being dimensioned vertically slightly to exceed the diameter of the O-ring including a strip that holds the O-ring by means of a spacer.

A device of this kind is known from DE-A-195 01 739. It has advantage that the O-ring that seals the nozzle plate in the lower part is readily replaceable without disassembling the lower part from the upper part. During the use of the nozzle beam, as for rinsing or also for replacement of the nozzle sheet, however, there is the danger of the O-ring slipping out of its bearing groove. This is particularly true when the nozzle beam, for reasons of advantage in the overall concept of the device, must be installed overhead or diagonally in the needling device.

SUMMARY OF THE INVENTION

The goal of the invention is to improve the device according to the species in such fashion that the O-ring, in any position or during any use of the nozzle beam, regardless of whether used as intended or during flushing or the like, is held in its bearing groove yet is readily replaceable, after being damaged for example.

To achieve the stated goal, the invention provides that c) the bearing groove is made larger than the diameter of the O-ring at the ends of the nozzle beam in the direction of the endwise ends, and d) the spacers for the O-ring are fastened to the strip with a space between them that exceeds the end position of the O-ring in the lower part.

The basic idea for this design feature is the fact that a rubber element, when stretched, becomes smaller in diameter. If the O-ring is stretched over the elongate strip, it can be introduced more easily into a bearing groove of a predetermined dimension. It is therefore necessary for the O-ring to be introduced into the bearing groove in the stretched state, for which reason the bearing groove must be made wider at the ends of the nozzle beam in the plane of the O-ring, so wide that the spacers are also movable on the elongate strip with the stretched O-ring into the plane of the bearing groove. It is advantageous for the bearing groove of the O-ring to be open in the direction of the ends of the nozzle beam. In this manner, a greatly stretched O-ring whose diameter is therefore considerably reduced can be introduced easily between the bearing groove flanks that extend parallel to the nozzle beam.

For easier movement of the elongate strip in the direction of the plane of the bearing groove, it is also provided according to the invention that on the side of the elongate strip that faces away from the spacers, in other words for example above the elongate strip, a positioning strip can be inserted into the repair groove. Therefore, during the installation of an O-ring, initially the elongate strip holding the stretched O-ring is inserted lengthwise into the nozzle beam that is open only at the ends and then the positioning strip is likewise inserted into the repair groove along the back of the elongate strip. The O-ring together with the elongate strip then moves into the plane of the bearing groove, uniformly over the entire length of the nozzle beam. Once the positioning strip is inserted, it is merely necessary to push the O-ring down off the spacers so that it is introduced into the bearing groove.

The U-shaped bearing groove is to be made conical outward, toward the opening, and narrowed, in other words in the shape of a swallowtail. It is especially advantageous in this connection for the side of the bearing groove that is open to the outside as viewed in cross section to have its inside diameter larger than the O-ring that is held stretched on the elongate strip, but smaller than the diameter of the relaxed O-ring. In this case, the O-ring, even in the least favorable position, can no longer slide out of the bearing groove and is nevertheless readily interchangeable without disassembling the nozzle beam.

BRIEF DESCRIPTION OF THE DRAWINGS

The drawings show a nozzle beam according to the invention as an example. Additional inventive details are explained with reference to this beam and/or the O-ring stretching device.

DETAILED DESCRIPTION OF THE PREFERRED EMBODIMENTS

Figure 1:
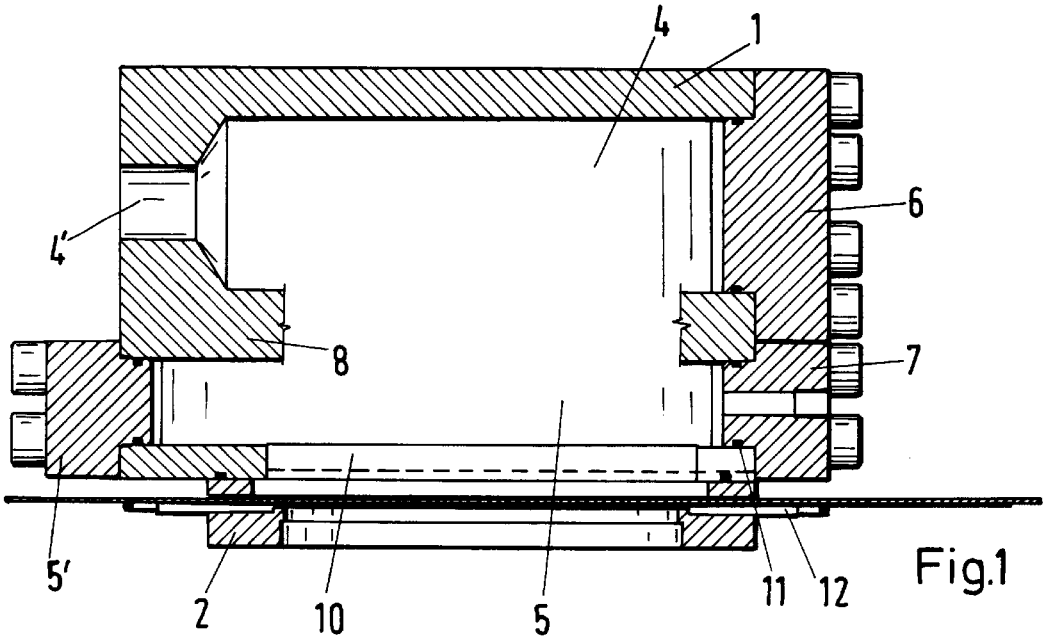
FIG. 1 shows a section lengthwise through a nozzle beam shown considerably shortened, with the elongate strip inserted and the O-ring held stretched on it.
Figure 2:
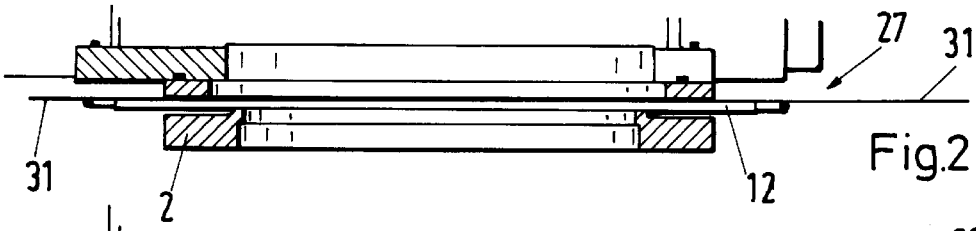
FIG. 2 shows the lower part according to FIG. 1, with the elongate strip inserted.

The housing of the nozzle beam consists of an upper part 1 that is screwed to lower part 2 at a number of points over its length from below by screws, not shown. Upper part 1 has two holes 4 and 5 lengthwise, of which the upper is the pressure chamber 4 and the lower is a pressure-distribution chamber 5, which can be eliminated in another design. Both chambers in this case are open at one end and screwed together in a fluid-tight manner by lids 6 and 7. At the other end, pressure chamber 4 has an opening 4' through which the fluid that is under pressure is introduced. Pressure-distribution chamber 5 is likewise screwed to this end by a lid 5' in a fluid-tight manner. The two chambers 4 and 5 are separated from one another by a partition 8. Over the length of the nozzle beam, a large number of through-flow holes 9 shown in FIG. 6 in partition 8 connect the two chambers so that the fluid flowing into pressure chamber 4 flows out uniformly distributed over the length into pressure-distribution chamber 5. The pressure-distribution chamber is open at the bottom, specifically by slit 10 that is narrow by comparison to the diameter of the bore in pressure-distribution chamber 5, said slot likewise extending over the length of the beam.

Figure 6:
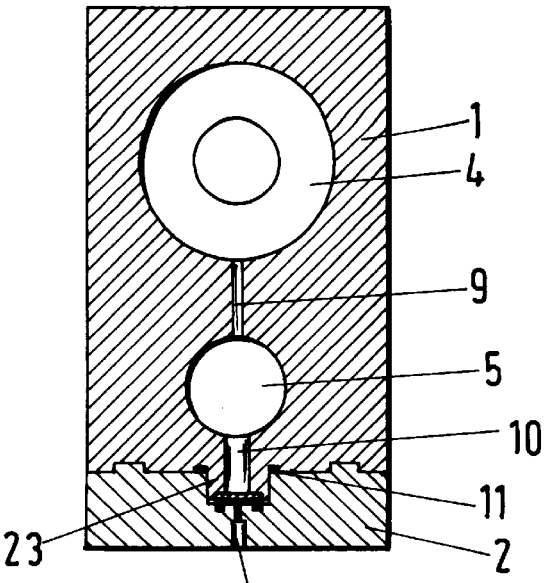
FIG. 6 is a cross section through the nozzle beam in FIG. 1.

According to FIG. 6, upper part 1 is screwed permanently and in a fluid-tight manner to lower part 2. Tightness is provided by O-ring 11. Between O-ring 11 and the slot 10 is a tongue projection 23 which is fitted in a corresponding groove 24 of lower part 2. In the bottom of groove 24 of lower part 2, a bearing groove 12" is again provided in which O-ring 12 rests to seal nozzle sheet 14 shown in FIG. 10. In a line below fluid through-flow bores 9 and slot 10, a slot 13 is also provided in lower part 2 which is very narrow in its upper part and leaves open only a little more than the width of the effective nozzle openings of nozzle sheet 14.

Figure 3:
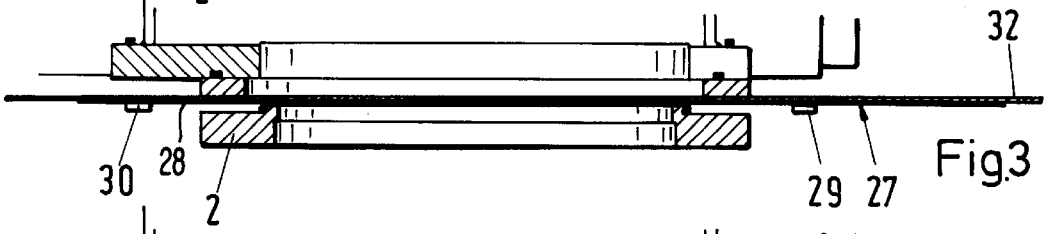
FIG. 3 shows the lower part according to FIG. 2, with the positioning strip also inserted and the O-ring released from the elongate strip.
Figure 4:
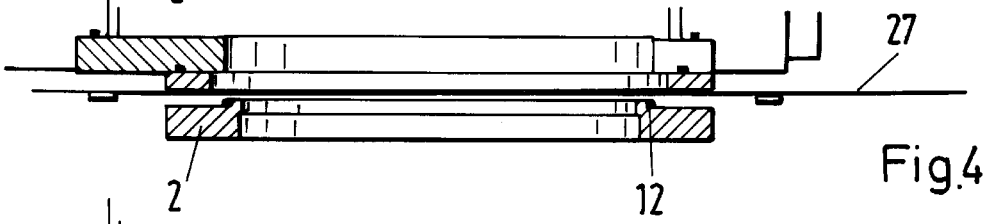
FIG. 4 shows the lower part according to FIG. 3 with the positioning strip pulled out and the elongate strip raised.
Figure 5:
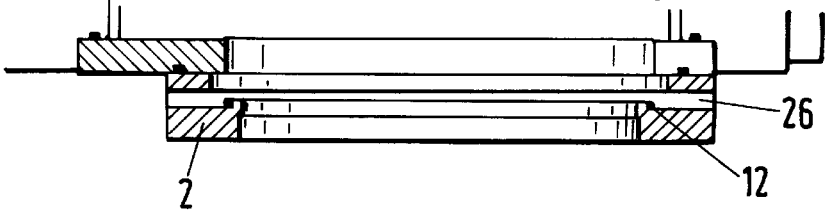
FIG. 5 shows the lower part according to FIGS. 2, 3, or 4, but with a newly introduced O-ring.
Figure 7:
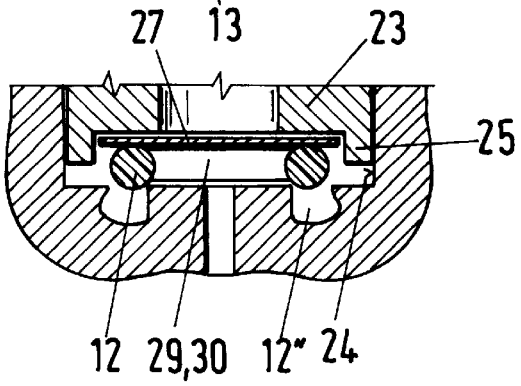
FIG. 7 shows a cross section on an enlarged scale of the repair groove with the elongate strip inserted and the O-ring held stretched on it.
Figure 8:
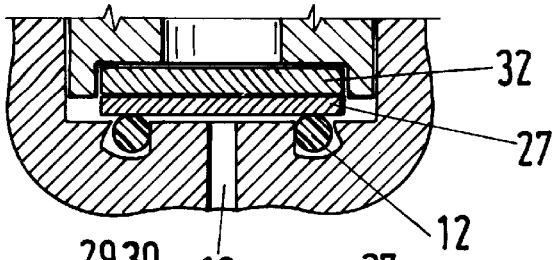
FIG. 8 shows in cross section the situation in FIG. 7 and additionally, positioning strips inserted over the elongate strip and an O-ring inserted into the bearing groove.
Figure 9:
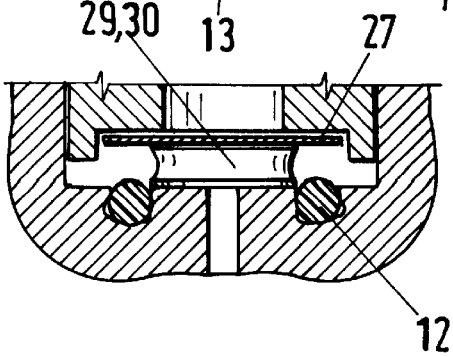
FIG. 9 shows in cross section on an enlarged scale the situation in FIG. 4 with a newly fitted released O-ring.

Upper part 1 has tongue projection 23 at its lower end. The latter, with its outer edges 25, leaves space for nozzle sheet 14. When pressurized with fluid, it is pressed by the fluid pressure against O-ring 12 and thus sealed from slot 13. It may become necessary to replace this O-ring 12. In order to avoid disassembling lower part 2 from upper part 1 and thus unscrewing the many screws that are required over the length of the nozzle beam, a repair groove 26 is milled into tongue projection 23 on the surface that is opposite bearing groove 12" for O-ring 12, said groove then being delimited by edges 25. Repair groove 26 extends over the entire length and width of bearing groove 12" for O-ring 12 of lower part 2 and corresponds heightwise to slightly more than the thickness of O-ring 12. An elongate strip 27 with a suitable dimension can be inserted into this repair groove 26, said strip having an O-ring stretching device on the underside 28 that is associated with bearing groove 12" of lower part 2. The O-ring stretching device consists of two spacers 29 and 30 that are attached to the underside of elongate strip 27 and have a diameter as shown in FIG. 9 that corresponds to the distance between the two bearing grooves 12". For better retention of O-ring 12, at least the outside contours of spacers 29 and 30 are provided with an annular groove that matches the diameter of stretched O-ring 12. A spacer can also be designed to be cylindrical in order to be able to push O-ring 12 more easily off spacers 29, 30. In addition, elongate strip 27 is made wider by an amount shown in FIG. 7, so that O-ring 12, held stretched, is covered at the top and is therefore also firmly held on elongate strip 27. An insertion end 31 can be gripped with the hand is advantageously provided at the end of elongate strip 27. As follows in particular from FIGS. 1 to 5, bearing groove 12" for O-ring 12 is designed to be completely open at the ends of the nozzle beam, in other words there is no outer limit at the ends for the bearing groove that is also present there with the internal bearing surface for O-ring 12. According to FIGS. 1 to 4, the spacers 29, 30 for the O-ring are fastened to elongate strip 27 much further apart than corresponds to the end position of O-ring 12 in bearing groove 12", which follows from FIG. 4 for example. In this manner, O-ring 12 is held on elongate strip 27 in a considerably stretched state. This causes the diameter of the O-ring to become smaller. Since bearing groove 12" at the ends of the nozzle beam has no limits, the elongate strip together with O-ring 12 can be moved in repair groove 26 in the direction of bearing groove 12" and so the stretched O-ring 12 can be introduced into the two bearing grooves 12". This movement of elongate strip 27, uniformly distributed over the length of the nozzle beam, can be facilitated by a positioning strip 32 which, as shown in FIG. 1, is made longer than elongate strip 27 and, according to FIGS. 1, 3, and 6, 8 is inserted above elongate strip 27 into repair groove 26. When the assembly state shown in FIGS. 1, 3 is reached, O-ring 12 is then rolled downward off the spacers 29, 30 so that, as shown in FIG. 3, it must necessarily jump into bearing groove 12". Then positioning strip 32 as shown in FIG. 4 is removed, elongate strip 27 lifted, and the latter then also pulled out of repair groove 26.

Figure 10:
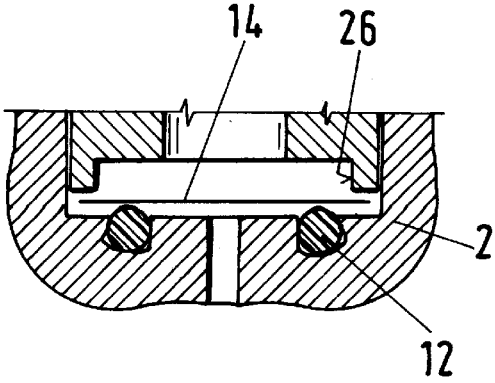
FIG. 10 shows in cross section the situation in FIG. 5 with the nozzle strip inserted.

An important feature of the device shown follows from FIGS. 7–10. The bearing groove 12" for O-ring 12 is not rectangular at the bottom of the groove but swallowtail-shaped. It is important that the side of bearing groove 12" that is open to the outside, shown here in cross section, has a larger inside diameter than the O-ring that is held stretched on elongate strip 27 (FIGS. 7 and 8), but is made smaller than the diameter of the relaxed O-ring 12 (FIGS. 9 and 10). Therefore, if the O-ring whose cross section has been reduced by stretching is moved through the opening and then, after being freed from spacers 29, 30, expands once again, then according to FIGS. 9 and 10 the O-ring is securely held in bearing groove 12" and can no longer escape therefrom by itself.

I claim:

1. Nozzle beam on a device for producing liquid streams, for example for stream interlacing of the fibers of a fiber web guided along the beam, a) which comprises an upper part extending over the working width of the web of goods and a lower part fastened thereto in a fluid-tight manner, i) with a pressure chamber being located in the upper part over its length, said chamber being supplied endwise for example with the fluid under pressure, ii) and with a nozzle sheet with the holes for the nozzles being mounted to the lower part in a fluid-tight manner by an O-ring, said ring being held on three sides in a U-shaped bearing groove in the lower part, and b) additionally, in the nozzle beam over its entire length and width, opposite the bearing groove, in the upper part of the nozzle beam, a repair groove is provided that is endwise of the nozzle beam and is open on at least one side, but is closable, said groove being dimensioned vertically to be slightly larger than the diameter of the O-ring, including a strip that holds the O-ring by means of a spacer, characterized in that c) the bearing groove is made larger at the ends of the nozzle beam in the direction of the endwise ends, than the diameter of the O-ring, and d) the spacers for the O-ring are fastened to the elongate sheet with a space between them on the elongate sheet, with the distance exceeding the end position of the O-ring in the lower part.

2. Nozzle beam according to claim 1, characterized in that the bearing groove at the ends of the nozzle beam corresponds in its dimension in the plane of the O-ring at least to the size of the associated spacer including the O-ring stretched thereover.

3. Nozzle beam according to claim 1, characterized in that the bearing groove in the plane of the inserted O-ring is designed at at least one end of the nozzle beam to be open in the direction of the end.

4. Nozzle beam according to claim 2, characterized in that the spacers of O-ring on the elongate strip in the lengthwise direction of the elongate strip are fastened much further apart from one another on the elongate strip than corresponds to the end position of the O-ring in the bearing groove.

5. Nozzle beam according to claim 4, characterized in that the elongate strip inserted into the repair groove, together with the stretched O-ring, is movable in the direction of the bearing groove and therefore the O-ring, stretched and held on the elongate strip, can be introduced into the bottom of the bearing groove.

6. Nozzle beam according to claim 5, characterized in that, on the side of the elongate strip that faces away from the spacers, and therefore above the elongate strip for example, a positioning strip can be inserted into the repair groove and thus the elongate strip and/or the O-ring held stretched on it can be moved toward the bottom of the bearing groove.

7. Nozzle beam according to claim 6, characterized in that the positioning strip is insertable over the entire length of the elongate strip into the repair groove and thus the elongate strip is displaced parallel to itself.

8. Nozzle beam according to claim 7, characterized in that the positioning strip is made at least as long as the elongate strip.

9. Nozzle beam according to claim 6, characterized in that the positioning strip corresponds heightwise to the diameter of the O-ring.

10. Nozzle beam according to claim 1, characterized in that the U-shaped bearing groove is narrowed conically outward toward the opening in a swallowtail-shape.

11. Nozzle beam according to claim 9, characterized in that the side of bearing groove that is open to the outside, as viewed in cross section, is larger in inside diameter than the O-ring held stretched on the elongate strip, but is made smaller than the diameter of the relaxed O-ring.

12. Nozzle beam according to claim 1, characterized in that at least one of the spacers, as viewed in the lengthwise direction of the elongate strip, at least radially externally, has an annular groove that advantageously matches the diameter of the stretched O-ring.

* * * * *